United States Patent [19]

Jones

[11] Patent Number: 4,615,291

[45] Date of Patent: Oct. 7, 1986

[54] HYDROFOIL BOAT

[76] Inventor: Clyde B. Jones, 3531 Alginet Dr., Encino, Calif. 91436

[21] Appl. No.: 698,341

[22] Filed: Feb. 4, 1985

Related U.S. Application Data

[62] Division of Ser. No. 408,710, Aug. 16, 1982, Pat. No. 4,517,912.

[51] Int. Cl.[4] ..... B63B 1/28

[52] U.S. Cl. ..... 114/280

[58] Field of Search ..... 114/61, 271, 274–282

[56] References Cited

U.S. PATENT DOCUMENTS

| | | | |
|---|---|---|---|
| Re. 28,615 | 11/1975 | Keiper | 114/282 |
| 1,186,816 | 6/1916 | Meacham | 114/281 |
| 2,387,907 | 10/1943 | Hook | 114/280 |
| 2,603,179 | 7/1949 | Gardiner | 114/280 |
| 2,703,063 | 3/1955 | Gilruth | 114/280 |
| 2,773,467 | 12/1956 | Bailey | 114/280 |
| 2,795,202 | 8/1957 | Hook | 114/280 |
| 2,856,877 | 10/1958 | Baker | 114/282 |
| 2,856,879 | 10/1958 | Baker | 114/275 |
| 3,104,642 | 9/1963 | Piazza | 114/280 |
| 3,141,437 | 7/1964 | Bush et al. | 114/276 |
| 3,236,202 | 2/1966 | Quady et al. | 114/282 |
| 3,286,675 | 11/1966 | Nason | 114/282 |
| 3,465,704 | 9/1969 | Baker | 114/276 |
| 3,561,388 | 2/1971 | Keiper | 114/282 |
| 3,747,549 | 6/1972 | Shutt | 114/39 |
| 3,762,353 | 9/1971 | Shutt | 114/39 |
| 3,797,434 | 3/1974 | Matthews | 114/280 |
| 3,929,084 | 12/1975 | Cline | 114/280 |
| 4,027,614 | 6/1977 | Jones | 114/282 |

*Primary Examiner*—Trygve M. Blix
*Assistant Examiner*—Jesus D. Sotelo

[57] ABSTRACT

A hydrofoil catamaran boat equipped with sail or power propulsion having mechanical type automatic heel, pitch and height control. The hydrofoil configuration has but one main load carrying foil located forward of the center of gravity necessitating two stabilizing hydrofoils at the stern which are differentially operated in angle of attack to provide heel control. Pitch control is attained by cooperative action of the main load carrying hydrofoil's automatic height control and the tracking capability of the stern stabilizing foils. All foils are retractable to facilitate beaching, trailering and storage. The configuration confines the main hydrofoil to the space between hulls thereby reducing normal hydrofoil configuration beam dimensions to more acceptable limits.

16 Claims, 12 Drawing Figures

HYDROFOIL BOAT

CROSS REFERENCES TO RELATED APPLICATIONS

This is a division from application Ser. No. 408,710 filed Aug. 16, 1982, now U.S. Pat. No. 4,517,912 issued May 21, 1985.

BACKGROUND OF THE INVENTION

1. Field of the Invention

This invention pertains to general arrangement of hydrofoils on a boat, the effect the arrangement has upon control and stability in the heel and pitch directions, the retraction of hydrofoils and the consolidation of the arrangement within a restricted envelope.

2. Description of Related Art

The main stream of sailing hydrofoil development has been directed toward heel control by wide spread principal load carrying hydrofoils or arranging the foils such that the load vectors from the foils pass through the intersection of the weight and sail load vectors, a so called compensated heel loading wherein little or no heel moment is experienced from sail loads. These designs resulted in sailing hydrofoil configurations with overall beam widths in excess of hull length, an arrangement which causes difficulty in tacking and docking, creates an appearance unacceptable by the consumer and causes wind blown spray from the windward foil to soak the crew.

Another difficulty in the main stream development has been the lack of sufficient pitch stability to handle wind gusts and rough water. The height control of these sailing machines depends on the area change of surface penetrating foils, which is insufficient to cause a forceful and immediate response to change in depth of the foil penetration. Ventilation of surface penetration type foils aggravates the stability problem. For the above reasons sailing hydrofoils have never been a commercial success.

The development of this invention is a result of sailing the experimental model depicted in U.S. Pat. No. 4,027,614. This model provided a number of combinations of hydrofoil arrangements. The one most successful but not shown was with the two mainfoils extending inboard with all other foils except the stabilizers retracted. This arrangement provided no heel stabilization from the main foils but the crew weight on the windward side provided sufficient stabilization for the sail loads required to execute a takeoff. As speed quickly increased after takeoff, the rudder mounted stern hydrofoils became more efficent in providing the major effort in heel control. This configuration was later improved by combining the two inboard foils into one continuous "V" shaped main hydrofoil mounted between the hulls enabling retraction forward to a position above the flotation waterline. This arrangement controlled height of the boat by area change of the "V" foil but proved to be marginal in pitch stabilization and required manual pitch attitude trimming of the boat. U.S. Pat. No. 4,517,912 describes the further improvement made to eliminate ventilation problems and provide a successful pitch stabilization system.

Computerized dynamic stability programs were written to simulate the experimental prototype in flight situations requiring stability, for instance, recovery from a severe gust. This program revealed that a forceful opposing reaction to vertical motion is required of the main hydrofoil in preventing a dive into the water as a result of a severe gust. This was corroborated by comparing operation of the fixed hydrofoil equipped prototype with the controlled angle of attack equipped modification.

Performance programs prepared utilizing refined drag data for each drag inducing component have reported surprisingly good performance which has been corroborated by sailing performance tests. The gains made in automatic or manual control of heel, automatic control of pitch attitude and height of the boat, elimination of ventilation problems and an impressive improvement in pitch stability has been well worth the price of minor sacrifices in performance at cruising speeds which in turn have been offset by greater allowable maximum speeds. Windward performance has been improved by the use of catamaran configuration. Sailing to windward involves a combination of flotation and foil support. With one hull in flotation, heel resistance is improved providing better windward vector component speeds than sailing more off the wind on the foils. However, on the foils actual boat speeds are superior.

SUMMARY OF THE INVENTION

This invention is a unique structural combination of a catamaran configurated boat equipped with heel control apparatus and a principal load carrying main hydrofoil retractable between the catamaran hulls. The main hydrofoil may incorporate automatic angle of attack control which enables a forceful corrective response to an errant vertical boat motion and thereby providing a much needed pitch stability. In operation the main hydrofoil carries a major portion of the vertical and side loads providing none or only a small amount of heel stability which is adequately provided for by the heel control apparatus.

The objectives of this invention are to eliminate hydrofoil arrays protruding beyond the beams of a catamaran in grotesque fashion by structurally arranging the principal load carrying main hydrofoil between the hulls where it is easily retractable. Additional objectives and benefits are: better tacking and handling in crowded marinas; reduction of manufacturing expense by having to produce only one foil instead of two; use of an "U" or "V" shaped foil which is more efficient than the ladder or cantilever foils; improvement of the appearance of the boat so important to sales appeal; facilitation of trailering, storing and beaching of the catamaran; positioning of the main hydrofoil between the hulls and under the deck or trampoline eliminates wind born spray from showering on the crew; provides a main hydrofoil positioned and designed to cooperate with a stern mounted heel control system in execution of full control of the boat in pitch, heel and direction; provides a component compatible in operation with patentee's U.S. Pat. No. 4,517,912 and U.S. Pat. No. 4,027,614.

The hydrofoil arrangements described herein are applicable to catamarans propelled by other means than sail. The foil system's function in addition to supporting the boat is to provide stability in pitch, heel and direction. The sail propelled version requires the most responsive effort in stability and control because of the greater asymmetry and variance of the sail forces, so the same system is directly applicable to other propulsion means such as powered aeropropellers or hydropropellers, hydrojets or any other means of thrust.

DESCRIPTION OF THE SHOWN EMBODIMENTS

Definitions

ANGLE OF ATTACK is the angle between the chord plane and a line passing thru the trailing edge of a hydrofoil, the line defining the direction of motion of the hydrofoil relative to the water, the angle being positive when the line is below the chord plane. See FLOW DIRECTION.

ANGLE OF INCIDENCE is the difference between the angles of attack of the main hydrofoil and the control hydrofoil, being positive when the control hydrofoil angle of attack is greater.

ANGLE OF ZERO LIFT is the angular difference between zero angle of attack and an angle of attack equivalent to zero lift.

ASPECT RATIO of a hydrofoil is the span divided by the chord or the span squared divided by the area if the planform is not rectangular.

CAMBERED HYDROFOIL section is one in which the upper surface has more curvature than the lower surface.

CENTER OF PRESSURE is the point on a hydrofoil at which one load vector can be applied representing the sumnation of all pressures imposed on the hydrofoil by water flow over the hydrofoil.

CHORD is the distance between the leading edge and the trailing edge of a hydrofoil in the chord plane.

CHORD PLANE is a plane defined by three points, two of which are on the trailing edge of a hydrofoil and the third on the leading edge.

DIHEDRAL ANGLE 5 is the angle between a horizontal reference line such as cross beam 2 and the chord plane of the main hydrofoil 4.

HYDROFOIL is defined as an airfoillike structure adapted to exert lifting loads when moving thru a body of water.

HYDROFOIL COMPOSITE is the combination of structure including the control hydrofoil, the main hydrofoil and the spring mechanism if a spring is used.

LEADING EDGE is the foremost edge of a hydrofoil.

LOAD VECTOR is a line representing the magnitude and direction of the total force created by the sumnation of all pressures imposed on a hydrofoil.

SPAN is the dimension of a hydrofoil perpendicular to the motion of the hydrofoil thru the water.

SYMMETRICAL HYDROFOIL section is one in which the upper and lower surfaces have identical curvature and offsets from the chord plane.

TIPS are the outboard extremities of the span of a hydrofoil.

TRAILING EDGE is the aftmost edge of a hydrofoil.

FLOW DIRECTION is the path a water particle makes relative to a hydrofoil chord plane, said water particle being at a distance from the hydrofoil such as to be undisturbed by the motion of the hydrofoil. The relative motion and angle is determined vectorially. See ANGLE OF ATTACK. The flow direction is the reference line for hydrofoil angle of attack on which foil section characteristics are based.

Figure 1:
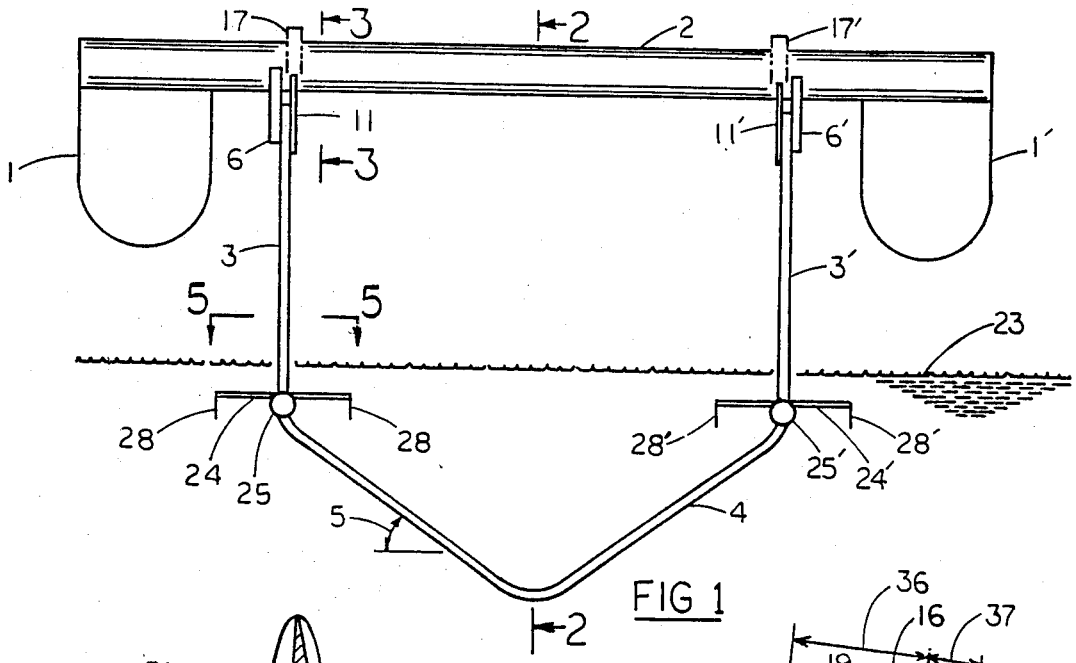
FIG. 1 is a front elevation showing the double strut version of the present invention.
Figure 2:
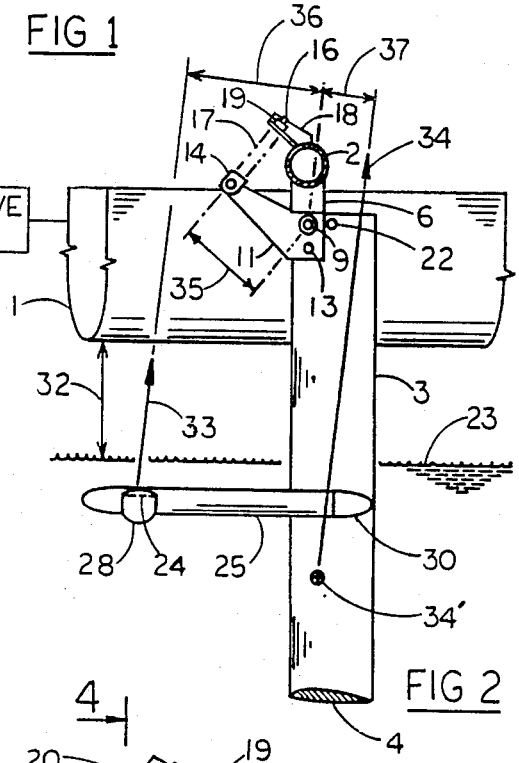
FIG. 2 is a side elevation sectional view of FIG. 1.

Referring to the drawings, FIGS. 1 and 2 illustrate catamaran hulls 1 and 1' interconnected by a cross beam 2, Struts 3 and 3' are the extensions of the main hydrofoil 4, being bent up from an aluminum extrusion of airfoil shape. The foil attachment means consists of a continuity of structure between the main hydrofoil 4 and the struts 3 and 3'. The main hydrofoil 4 is formed with a dihedral angle 5 between 0 and 60 degrees, preferably 35 degrees.

Figure 4:
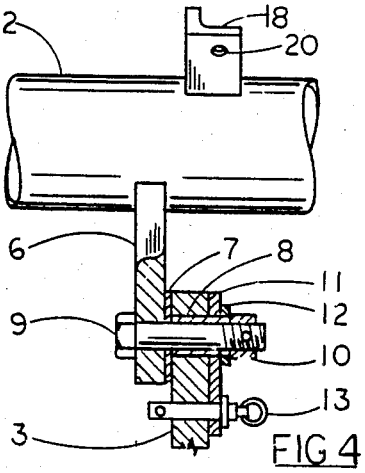
FIG. 4 is a cross sectional view showing additional detail of FIG. 3.
Figure 3:
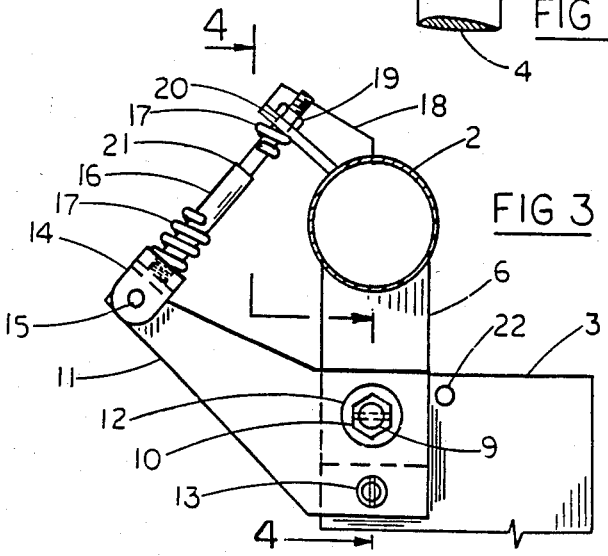
FIG. 3 is a cross sectional view of FIG. 1 hull attachment means including pivotal mount of the struts, spring, stops and adjusting means.

Struts 3 and 3' are attached to cross beam 2 by hull attachment means illustrated in FIGS. 3 and 4. The illustrations are for the right strut 3 and parts for mounting strut 3' are identical but arranged in mirror image on the left side. Strut 3 is mounted inboard of bracket 6 which is welded to cross beam 2. Thrust washer 7 and bushing 8 are clamped by pivot bolt 9 and slotted nut 10 to bracket 6 with strut 3, lever 11 and inboard thrust washer 12 riding on bushing 8 between thrust washer 7 and slotted nut 10. Clearances are provided to give strut 3, lever 11 and inboard thrust washer 12 freedom of rotation about bushing 8. When strut 3 is in the position shown, quick release pin 13 is engaged, locking strut 3 and lever 11 together to rotate about bushing 8. Clevis 14 is straddle mounted on lever 11 and retained by pin 15. Rod 16 is threaded into clevis 14 at one end and the other end of rod 16 passes through spring 17, hole 20 in bracket 18 and is retained by nut 19. Bracket 18 is welded to cross member 2. Rod 16 has a shoulder diameter larger than hole 20 forming stop 21 for passage of rod 16 into hole 20 when spring 17 is compressed. Nut 19 is the adjustable stop for passage of rod 16 out of hole 20. When quick release pin 13 is pulled, the main hydrofoil and all associated parts may be rotated forward until hole 22 can be engaged by quick release pin 13 thereby holding main hydrofoil 4 and associated parts in a retracted position for beaching and transportation purposes. The foregoing arrangement provides a second retraction means enabling movement of the main hydrofoil 4 to a position above the draft of the hulls 1.

Figure 5:
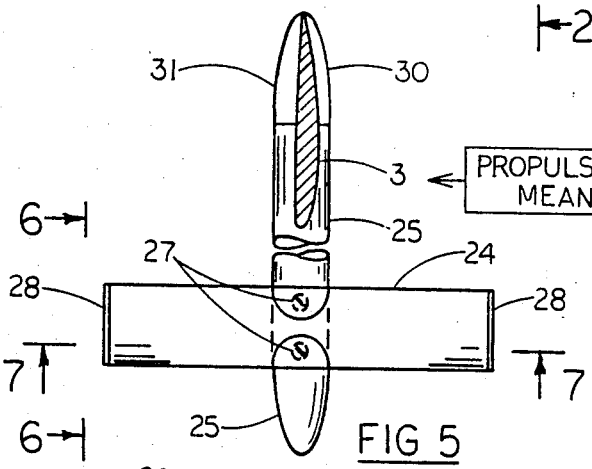
FIG. 5 is a cross sectional view of FIG. 1 showing a plan view of the control hydrofoil on the structural support.
Figure 6:
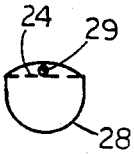
FIG. 6 is a side elevation of FIG. 5 showing the end plates.
Figure 7:
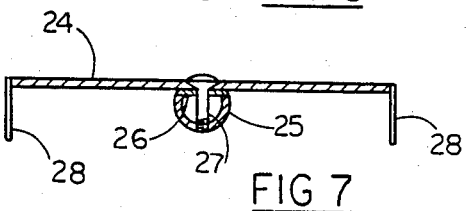
FIG. 7 is a cross sectional view of FIG. 5 showing mounting detail of the control hydrofoil on the structural support.

Control hydrofoil 24 shown in FIGS. 5 and 7 is made of aluminum with an asymmetrical airfoil shape. It is mounted on a connecting means consisting of a structural support 25 made from an aluminum tube. The mounting surface consists of a shim 26 seated in a cutout of structural support 25 so the mounting surface under shim 26 is parallel to the axis of structural support 25. Shim 26 is of sufficient thickness to permit grinding to change the fore and aft angle of the seat relative to the axis of structural support 25 by at least ±2°. The control hydrofoil 24 is retained by two screws 27 tapped into the bottome side of structural support 25. Once shim 26 is adjusted to the proper angle of incidence, it is bonded to structural support 25. The forward end of structural support 25 is cut and closed to achieve a streamlined shape. The end plate 28 follows the upper surface contour of control hydrofoil 24 and extends downward a distance equivalent to one chord of the control hydrofoil 24. End plate 28 is fastened to control hydrofoil 24 at each tip by screw 29 plus bonding. The aft portion of structural support 25 is cut out to slip over strut 3 and is welded. The blunt aft end of structural support 25 is streamlined with plastic fairings 30 and 31. The structural support 25 is located on strut 3 at a vertical position so that control hydrofoil 24 is approximately ½ chord length below the water surface 23 when hull 1 is supported above the water surface 23 at a predetermined height 32 and the struts 3 and 3' are vertical.

In operation, the moments generated by control hydrofoil 24 about pivot bolt 9 axis must balance moments generated by main hydrofoil 4 and spring 17 about pivot bolt 9 axis for a steady state condition. Such a control hydrofoil 24 load will be referred to as a moment balancing load. A moment balancing load can be achieved without spring 17 but spring 17 serves the purpose of forcing the hydrofoil composite to a lower angle of attack for sailing in flotation and provides a moment gradient about pivot bolt 9 opposing undesirable increases in the hydrofoil composite angle of attack when flying on the foils. Therefore, inclusion of spring 17 is the preferred arrangement.

Spring 17 and rod 16 with stop 21 and stop nut 19 are used to adjust spring load. This is useful in trimming the depth of operation of control hydrofoil 24 by screwing rod 16 in or out of clevis 14. Stops can be adjusted by combination of use of threaded connections at both ends of rod 16.

FIG. 2 illustrates control hydrofoil 24 load vector 33 and main hydrofoil 4 load vector 34 acting in relation to pivot bolt 9 axis. Spring 17 is acting at moment arm 35. When main hydrofoil 4 rotates forward, the moment arms 35 and 36 change relatively small in percentage, while the main hydrofoil 4 moment arm 37 can change radically or reverse direction. It should be understood that the aforementioned radical percentage changes in moment arm 37 length occur as a result of variations in direction of flow over main hydrofoil 4 whether the flow direction changes are caused by vertical or pitch motion of the boat relative to the water surface, by local conditions under the surface such as in a wave, or by rotation of the hydrofoil composite. It is a fundamental characteristic of any hydrofoil such as main hydrofoil 4 to generate a total load represented by load vector 34 which has a predictable angular relationship to flow direction over the main hydrofoil 4 and a predictable point of application, center of pressure 34', of the load vector 34 on main hydrofoil 4. This fundamental characteristic includes load vector 34 moving with changes in flow direction. Therefore, the main hydrofoil load vector 34 rotates about a translating center of pressure 34' in unison with changes of flow direction resulting in variances of magnitude of load vector 34 and moment arm 37 length. For example, a downward motion of the hull at pivot bolt 9 will cause an upflow over main hydrofoil 4 thereby increasing the magnitude of load vector 34. The center of pressure 34' moves forward shortening the moment arm 37, a fundamental characteristic of cambered hydrofoil sections. Load vector 34 rotates about center of pressure 34' toward pivot bolt 9 causing additional shortening of moment arm 37. With pivot bolt 9 properly located relative to main hydrofoil 4, moment arm 37 length will decrease percentagewise more than the magnitude of load vector 34 increases percentagewise causing main hydrofoil 4 moment about pivot bolt 9 to decrease. Consequently, the moments about pivot bolt 9 are unbalanced in a direction to cause an increase in angle of attack of the hydrofoil composite. Control hydrofoil 24 also experiences an increase of flow angle causing a further increase of angle of attack of the hydrofoil composite. The foregoing illustrates the mutually cooperative effort of the main and control hydrofoils resulting in a forceful opposition to vertical motions of the boat. This unique situation in which stabilized moments of the control and main hydrofoils oppose each other but dynamic moments, ie., changes in moments from the stabilized condition, are supportive of each other is achieved as illustrated in FIG. 2 where pivot bolt 9 is located approximately vertically above the main hydrofoil 4 so that moment arm 37 is less than one main hydrofoil 4 chord length when the hydrofoil composite is in a stabilized normal operating position.

It should be noted that the above described opposition to vertical motion is reversed for an upward motion of the hull at pivot bolt 9 so that the hydrofoil composite's response opposes the motion by a decrease in angle of attack. In waves or in recovery from an errant upward vertical motion of the hull, the control hydrofoil 24 may broach the water surface 23 leaving only spring 17 to force the hydrofoil composite to rotate to a lower angle of attack if hull and hydrofoil angular relationships are severe enough to cause load vector 34 to pass forward of pivot bolt 9. Under these circumstances, the moment of the spring rate of spring 17 must exceed the mathematical differential of load vector 34 moment about pivot bolt 9 in respect to spring motion.

In order to establish the range of pivot bolt 9 horizontal location that satisfies individual design requirements, an equation representing the moment of load vector 34 about pivot bolt 9 should be differentiated in respect to angle of attack of the main hydrofoil 4 and solved for the location of pivot bolt 9 with the differential equation set equal to zero. This gives the most forward position for pivot 9. A position aft of the most forward position of pivot bolt 9 will produce a decrease in moment with increase in angle of attack. The maximum aft position of pivot bolt 9 is where load vector 34 passes through pivot bolt 9 when the hydrofoil composite is in normal flight position. A computerized dynamic analysis of the complete prototype boat system and tests of the prototype indicate that the optimum position for pivot bolt 9 is in a range of plus or minus ⅛ chord of half way between the most forward and aft positions as established by the above procedure.

In operation, the function of control hydrofoil 24 is to regulate the angle of attack and lift load of main hydrofoil 4. The moment balancing load capability of control hydrofoil 24 is influenced by the depth of submergence below water surface 23. The moment balancing load capability increases rapidly to 60% at a depth of ½ control hydrofoil's 24 chord, increases progressively slower to 75% at a depth of 1 chord and finally approaches asymptotically to 100% of full load capacity at 2 to 3 chords depth. At a very shallow depth the upper surface flow of control hydrofoil 24 separates and the lift load capability is limited to that generated by hydroplaning alone. When a cavity forms on a hydrofoil surface from either cavitation or ventilation, the flow over the cavity is not in contact with the hydrofoil surface and such flow is described as separated.

A hydrofoil operating submerged can exceed a speed where the pressures over the top of the hydrofoil become less than the vapor pressure of the water causing a vapor filled cavity to be formed with detrimental effects upon the lift and drag. This is called cavitation and occurs mostly beyond the normal speed range of sailing hydrofoils. At shallow depth, if any portion of the hydrofoil penetrates the surface, air can find a path for intrusion into the low pressure area on the upper surface of the hydrofoil thereby forming an air filled cavity. This is ventilation and can occur at normal operating speeds. Ventilation can also be caused by air finding an access path thru the core of a vortex formed at the tip of the hydrofoil and trailing up to the water surface 23 where the air enters. This latter problem is prevented by the end plates 28 which inhibit the forming of an open core in the vortex. Ventilation from surface penetration is prevented by structurally assuring a submerged position of the control hydrofoil 24 and the prevention of hydroplaning loads which will cause the control hydrofoil to rise to the surface. End plates 28 also increase the effective aspect ratio of control hydrofoil 24 thereby increasing efficiency.

In operation, the control hydrofoil 24 normally is submerged at a depth of about ½ chord when the sailboat is trimmed in a stable condition, If an outside influence such as a wind gust forces the bow down increasing the depth of submergence of control hydrofoil 24, the load vector 33 on control hydrofoil 24 increases and rotates the main hydrofoil 4 forward. The angle of attack of the main hydrofoil 4 increases causing an increase in load vector 34 and an upward corrective motion of the boat.

A bow up disturbance of the boat causes the control hydrofoil 24 to rise toward the water surface 23. If the disturbance is sufficiently forceful, the control hydrofoil 24 may break thru the water surface 23 and attempt to hydroplane. Hydroplaning is objectionable because of reduced efficiency and the throwing of spray.

Hydroplaning is defined here as the generation of lift loads on a hydrofoil by dynamic impact of the water on the bottom surface of the hydrofoil while the upper surface flow is separated contributing little if any to the lift loads. This can occur when the hydrofoil is skimming along the water surface 23 or when the hydrofoil is submerged and the flow over the upper hydrofoil surface is separated. When submerged and flow attached on the upper surface, a hydrofoil can generate a lift load many times the lift load of a hydroplaning hydrofoil.

Hydroplaning is prevented by structurally building in an angle of incidence of control hydrofoil 24 which for a given size and airfoil characteristics renders the control hydrofoil 24 incapable of sustaining moment balancing loads by hydroplaning alone. The same angle of incidence in combination with a substantial angle of zero lift and aspect ratio enables the control hydrofoil 24 to generate moment balancing loads when it is submerged and the upper surface flow is attached.

Should the control hydrofoil 24 in choppy conditions try to operate above the chop trough, the flow on control hydrofoil's 24 upper surface separates causing control hydrofoil 24 to dive. Since the separated cavity tends to hang on to control hydrofoil 24 for a short period, control hydrofoil 24 cannot maintain a position above the chop trough even while going thru the chop crest. Instead, control hydrofoil 24 seeks a position of minimum load capability at a shallow submergence below the chop trough thereby enabling the control hydrofoil 24 to average the load experienced while traversing under the chop crest to the required moment balancing load.

In operation when heeling, the control hydrofoils 24 and 24' have unequal depth of submergence. However, if the heel angle is large enough, the windward control hydrofoil can operate above the water surface providing that the lee control hydrofoil can generate enough moment about pivot bolt 9 to balance the spring and main hydrofoil moments. If the lee control hydrofoil cannot balance moments, then the hydrofoil composite will reduce angle of attack and recover at a lower hull height above the water surface where the hydrofoil composite will stabilize with both control hydrofoils submerged.

Figure 8:
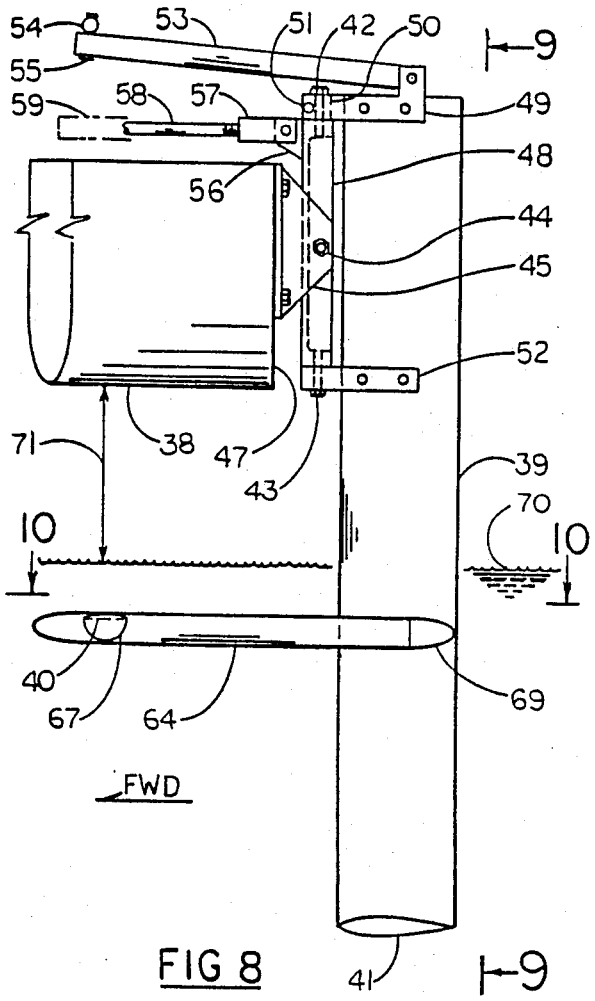
FIG. 8 is a side elevation showing a single strut version of the present invention.
Figure 9:
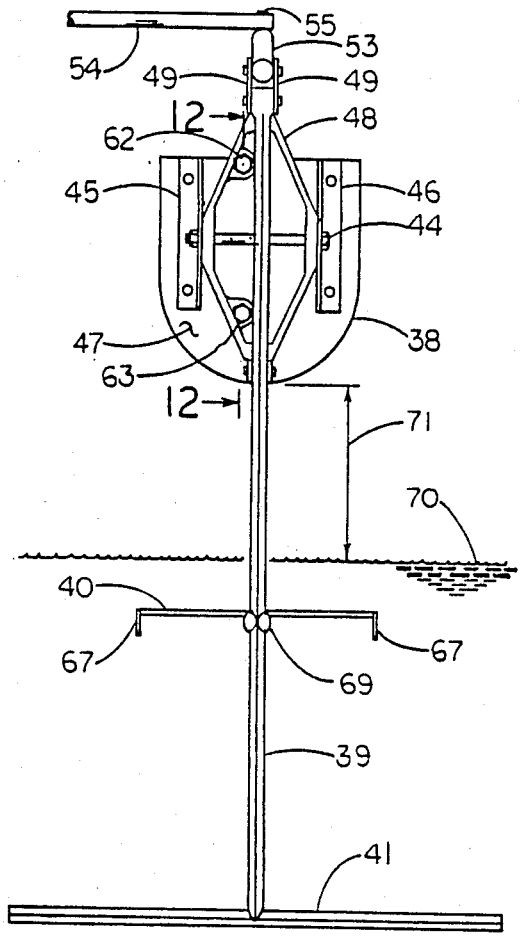
FIG. 9 is an elevation looking forward at FIG. 8 and showing additional detail of FIG. 8.

Referring to the drawings, FIGS. 8 and 9 illustrate a catamaran hull 38 equipped with a strut 39, control hydrofoil 40 and stern hydrofoil 41 such that the last three parts mentioned may collectively rotate about vertical hinge bolts 42 and 43 and beamwise horizontal pivot bolt 44. This identical arrangements is installed on both hulls but only the right hull 38 is shown. This arrangement adapts strut 39 to be used as a rudder.

Brackets 45 and 46 are bolted to transom 47 providing support of pivot bolt 44 which pivotably mounts gimbal 48 between brackets 45 and 46. The upper hinge fitting 49 is made up of flat plate, one being bolted on each side of strut 39. Cubical block 50 is clamped lightly by bolt 51 between the two fittings 49 so that fittings 49 are free to rotate about bolt 51. Block 50 is retained in contact with gimbal 48 by hinge bolt 42 which is screwed into gimbal 48 leaving block 50 free to rotate about hinge bolt 42. Lower hinge fitting 52 is machined to fit around strut 39 to which lower hinge fitting 52 is bolted. Lower hinge bolt 43 is screwed into gimbal 48 through lower hinge fitting 52 leaving lower hinge fitting 52 free to rotate about lower hinge bolt 43. By removing lower hinge bolt 43, the whole rudder and hydrofoil assembly is free to retract by rotating aft about bolt 51 for transportation and beaching purposes. The foregoing arrangement provides a first retraction means enabling movement of the stern hydrofoil 41 to a position above the draft of the hull 38.

The upper hinge fitting 49 provides mounting for tiller 53. Tiller 53 is interconnected with the left rudder tiller by cross tube 54 which is pivotably mounted on tiller 53 by pin 55.

Gimbal 48 provides a lug 56 to which clevis 57 is pivotably attached. Connecting rod 58, screwed into clevis 57, is interconnected with its counterpart on the left hull by linkage 59 so that the motion of the right strut 39 about horizontal pivot bolt 44 produces the opposite direction of motion by the left strut about its horizontal pivot axis. This arrangement is illustrated and described in U.S. Pat. No. 4,027,614.

Figure 12:
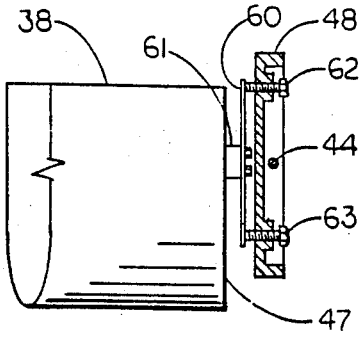
FIG. 12 is a cross sectional view of FIG. 9 showing the spring and spring adjustment means.

Spring 60 shown in FIG. 12 is rigidly mounted on transom 47 on block 61. Spring 60 provides forces tending to position strut 39 about pivot bolt 44 by adjustment of bolts 62 and 63 screwed into gimbal 48. Strut 39 travel about pivot bolt 44 is limited by transom 47, thereby providing stops.

Figure 10:
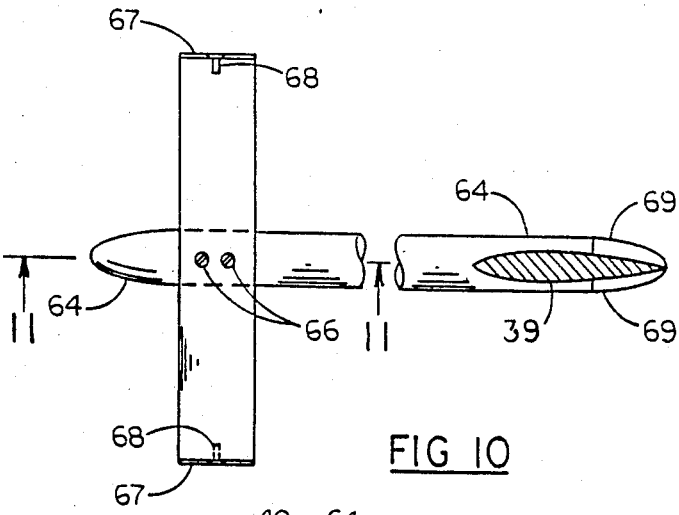
FIG. 10 is a sectional plan view of FIG. 8 showing the control hydrofoil and structural support.
Figure 11:
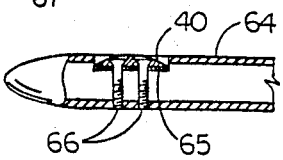
FIG. 11 is a cross sectional view of mounting detail of the control hydrofoil.

Foil attachment means consists of stern hydrofoil 41 being welded to the lower end of strut 39. Control hydrofoil 40, FIGS. 10 and 11, is mounted on structural support 64. The mounting surface consists of a shim 65 seated in a cutout of structural support 64 so that the mounting surface under shim 65 is parallel to the axis of structural support 64. Shim 65 is of sufficient thickness to permit grinding to change the fore and aft angle of the seat relative to the axis of structural support 64 by at least ±4°. The control hydrofoil 40 is retained by two screws 66 tapped into the bottom side of structural support 64. Once shim 65 is adjusted to the proper angle of incidence, it is bonded to structural support 64. The forward end of structural support 64 is cut and closed to achieve a streamlined shape. The end plate 67 follows the upper surface contour of control hydrofoil 40 and extends downward a distance equivalent to one chord of the control hydrofoil 40. An end plate 67 is fastened to control hydrofoil 40 at each tip by a screw 68 plus bonding. The aft portion of structural support 64 is cut out to slip over strut 39 and is welded. The blunt aft end of structural support 64 is streamlined by plastic fairings 69. The structural support 64 is located on strut 39 at a vertical position so that control hydrofoil 40 is approximately ½ chord length below the water surface 70 when the hull 38 is supported above the water surface 70 at a predetermined height 71 and the strut 39 is vertical.

The basic system of FIG. 8 does not include rudder capability or interconnection by linkage 59. Such an arrangement requires a rigid attachment of strut 39 to gimbal 48 by welding upper and lower hinge fittings 49 and 52 to gimbal 48. This arrangement renders the basic system free to independently regulate the height 71 of hull 38 at the location of the unit on hull 38.

The principle of operation of configuration of FIG. 8 is the same as for the configuration of FIG. 1. Both species are limited to controlling the height only at that part of the hull to which they are attached. The configuration FIG. 1 is more efficient than configuration FIG. 8, particularly when subjected to side loads in addition to vertical loads, but is not adaptable in a practical sense for use as a rudder or as an antiheel device. Because of these limitations, the two species are advantageously used in combination as components of a complete system where they cooperatively extend their capability of regulation of height of a portion of the hull to a fully automatic control of a boat in pitch, heel and height above the water surface.

A complete boat system comprising a pair of units of configuration FIG. 8 spaced apart in a beam direction at the stern and configuration FIG. 1 located forward of the boat center of gravity is particularly suited for a sailboat. In this arrangement configuration FIG. 1 provides the major portion of lifting load to support the boat and also provides control of height near the boat center of gravity but has only a minor effect on heeling stability. Configuration FIG. 8 provides loads to stabilize the boat in pitch, heel and direction and also regulates the height of the stern, but has little effect on the lifting loads and the height of the boat near the center of gravity. Obviously, configurations FIG. 1 and FIG. 8 must operate cooperatively for successful operation of the complete system and to satisfy the above stated lifting load condition, the main hydrofoil 4 of FIG. 1 must be located forward of the boat's center of gravity at a distance less than the distance the stern hydrofoils 41 of FIG. 8 are displaced aft of the boat's center of gravity.

The interconnection by linkage 59 of the units of configuration FIG. 8 in the described complete boat system interlocks each configuration FIG. 8 unit such that the control hydrofoils are capable of controlling the stern hydrofoils in opposite directions only which provides control of boat heel. The stern height is controlled by the configuration FIG. 8 stern hydrofoils as they trail behind configuration FIG. 1 hydrofoils. The boat will assume an attitude and stern height as determined by the average angle of attack of the configuration FIG. 8 stern hydrofoils which must generate an up or down resultant load to stabilize the boat in pitch attitude. The average angle of attack is adjustable by screwing connecting rod 58 in or out of clevis 57. This trim adjustment needs little attention since the boat will automatically assume an attitude that stabilizes pitch and considerable range of pitch attitude is permissible. The interconnection linkage 59 enables the stern mounted configuration FIG. 8 stern hydrofoils to control heel without effecting the pitch attitude. The interconnection linkage 59 also enables the control hydrofoil 40 on the downwind side to control both left and right stern hydrofoils 41 even though the heel angle is enough to cause the windward control hydrofoil 40 to lift completely above the water surface 70.

I claim:

1. In combination, a boat comprising:

(a) two hulls in catamaran configuration, (b) a rudder means for directional control of said boat, (c) a propulsive means for propelling said boat, (d) two stern hydrofoils, spaced apart beamwise, located aft of said boat's center of gravity and below the draft of said hulls, (e) two first attachment means for mounting each of said stern hydrofoils on said boat, (f) a main hydrofoil located forward of said boat's center of gravity at a distance less than the distance said stern hydrofoils are displaced aft of said boat's center of gravity whereby said main hydrofoil supports at least one-half of said boat's weight, said main hydrofoil generally centered between said hulls and located below the draft of said hulls, all portions of said main hydrofoil being inboard of the vertical projections of the inboard side of said hulls in level position, (g) a second attachment means for mounting said main hydrofoil on said boat, (h) whereby, when said propulsive means is activated, said boat may be operated while supported by flotation or while entirely supported above a body of water by the cooperative effort of said main hydrofoil and said stern hydrofoils.

2. Apparatus as defined in claim 1, further comprising:

(a) two first pivot means, one for each said stern hydrofoil, for providing a freedom of rotational movement of at least a portion of each said stern hydrofoil effecting a change in angle of attack, (b) a linkage means for interlocking the angle of attack of said stern hydrofoils such that when a change in angle of attack of one of said stern hydrofoils is executed the other said stern hydrofoil changes angle of attack in the opposite direction, (c) whereby, said stern hydrofoils operate cooperatively in response to actuation of said linkage means to control heel and stabilize said boat's pitch attitude.

3. Apparatus as defined in claim 1, further comprising:

(a) two first pivot means, one for each said stern hydrofoil, for providing a freedom of rotational movement of at least a portion of each said stern hydrofoil effecting a change in angle of attack, (b) two first control means, one for each said stern hydrofoil, responsive to depth of submergence of said stern hydrofoil, for regulating each said stern hydrofoil's angle of attack, (c) whereby, the depth of submergence of each of said stern hydrofoils is independently and automatically controlled thereby controlling the heel attitude of said boat and in cooperation with said main hydrofoil in maintaining a stabilized pitch attitude of the boat.

4. Apparatus as defined in claim 3, further comprising:

(a) a linkage means for interlocking the angle of attack of said stern hydrofoils such that when a change in angle of attack of one of said stern hydrofoils is executed the other said stern hydrofoil changes angle of attack in the opposite direction, (b) whereby, said stern hydrofoils operate cooperatively, in response to said first control means, for heel control while assuring independence of heel control and pitch control loads.

5. Apparatus as defined in claim 4, wherein:

(a) said two first control means each comprising a control hydrofoil responsive to proximity of the water surface, associated with each said stern hydrofoil by connecting means, for applying independent regulatory forces to each said stern hydrofoil effecting change in angle of attack.

6. Apparatus as defined in claim 5, further comprising:

(a) two first resilient means, one of said first resilient means associated with each said first attachment means, for applying an independent predetermined variation of moments to said stern hydrofoil about said first pivot means forcing said stern hydrofoil in a direction to decrease angle of attack.

7. Apparatus as defined in claim 6, further comprising:

(a) two first retraction means, one of said first retraction means associated with each said first attachment means, for moving said stern hydrofoil to a position above the draft of said hulls, (b) a second retraction means associated with said second attachment means for moving said main hydrofoil to a position above the draft of said hulls.

8. Apparatus as defined in claim 1, further comprising:

(a) a second pivot means for providing a freedom of rotational movement of at least a portion of said main hydrofoil effecting a change in angle of attack, (b) a second control means, responsive to said main hydrofoil's depth of submergence, for regulating said main hydrofoil's angle of attack, (c) whereby, said main hydrofoil automatically regulates the height of said boat above said body of water and in cooperation with said stern hydrofoils automatically stabilizes said boat in pitch attitude.

9. Apparatus as defined in claim 8, further comprising:

(a) two first pivot means, one for each said stern hydrofoil, for providing a freedom of rotational movement of at least a portion of each said stern hydrofoil effecting a change in angle of attack, (b) a linkage means for interlocking the angle of attack of said stern hydrofoils such that when a change in angle of attack of one of said stern hydrofoils is executed the other said stern hydrofoil changes angle of attack in the opposite direction, (c) whereby, said stern hydrofoils operate cooperatively in response to actuation of said linkage means to control heel and stabilize said boat's pitch attitude.

10. Apparatus as defined in claim 9, further comprising:

(a) a second resilient means, associated with said second attachment means, for applying a predetermined variation of moments to said main hydrofoil about said said second pivot means forcing said main hydrofoil in a direction to decrease angle of attack.

11. Apparatus as defined in claim 10, further comprising:

(a) two first retraction means, one of said first retraction means associated with each said first attachment means, for moving said stern hydrofoil to a position above the draft of said hulls, (b) a second retraction means associated with said second attachment means for moving said main hydrofoil to a position above the draft of said hulls.

12. Apparatus as defined in claim 11, wherein:

(a) said second control means comprises at least one control hydrofoil, responsive to proximity of the water surface, associated with said main hydrofoil by connecting means, for applying regulatory forces to said main hydrofoil effecting a change in angle of attack.

13. Apparatus as defined in claim 9, further comprising:

(a) two first control means, one for each said stern hydrofoil, responsive to depth of submergence of said stern hydrofoil, for regulating each said stern hydrofoil's angle of attack, (b) whereby, said stern hydrofoils operate cooperatively in response to said first control means for heel control and pitch control, assuring independence of heel control and pitch control loads.

14. Apparatus as defined in claim 13, further comprising:

(a) two first resilient means, one of said first resilient means associated with each said first attachment means, for applying an independent predetermined variation of moments to said stern hydrofoil about said first pivot means forcing said stern hydrofoil in a direction to decrease angle of attack.

15. Apparatus as defined in claim 14, further comprising:

(a) two first retraction means, one of said first retraction means associated with each said first attachment means, for moving said stern hydrofoil to a position above the draft of said hulls, (b) a second retraction means associated with said second attachment means for moving said main hydrofoil to a position above the draft of said hulls.

16. Apparatus as defined in claim 15, wherein:

(a) said two first control means each comprising a control hydrofoil responsive to proximity of the water surface, associated with each said stern hydrofoil by connecting means, for applying independent regulatory forces to each said stern hydrofoil effecting a change in angle of attack, (b) said second control means comprising at least one control hydrofoil, responsive to proximity of the water surface, associated with said main hydrofoil by connecting means, for applying regulatory forces to said main hydrofoil effecting a change in angle of attack.

* * * * *